US007487934B2

(12) United States Patent
Johnsson

(10) Patent No.: US 7,487,934 B2
(45) Date of Patent: Feb. 10, 2009

(54) METHOD OF SYNCHRONIZING FIN FOLD-OUT ON A FIN-STABILIZED ARTILLERY SHELL, AND AN ARTILLERY SHELL DESIGNED IN ACCORDANCE THEREWITH

(75) Inventor: Stig Johnsson, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 179 days.

(21) Appl. No.: 11/530,520

(22) Filed: Sep. 11, 2006

(65) Prior Publication Data

US 2007/0114323 A1 May 24, 2007

Related U.S. Application Data

(62) Division of application No. 10/471,458, filed as application No. PCT/SE02/00550 on Mar. 20, 2002, now Pat. No. 7,104,497.

(30) Foreign Application Priority Data

Mar. 20, 2001 (SE) ..... 0100956

(51) Int. Cl.
*F42B 15/01* (2006.01)

(52) U.S. Cl. ..... 244/3.29; 102/348

(58) Field of Classification Search ..... 244/3.1, 244/3.21, 3.23, 3.24, 3.27, 3.29, 3.28, 3.3; 102/348

See application file for complete search history.

(56) References Cited

U.S. PATENT DOCUMENTS

| | | | |
|---|---|---|---|
| 2,784,669 | A | 3/1957 | Apotheloz et al. |
| 2,822,995 | A | 2/1958 | Bowen |
| 2,928,346 | A | 3/1960 | Grimes |
| 3,260,205 | A | 7/1966 | Dietrich et al. |
| 3,415,520 | A | 12/1968 | Woodward |
| 3,498,178 | A | 3/1970 | Meyer et al. |
| 4,272,040 | A | 6/1981 | Bastian et al. |
| 4,296,895 | A | 10/1981 | Pazmany |
| 4,323,208 | A | 4/1982 | Ball et al. |
| 4,460,137 | A | 7/1984 | Andersson et al. |
| 4,546,940 | A | 10/1985 | Andersson et al. |

(Continued)

FOREIGN PATENT DOCUMENTS

| | | |
|---|---|---|
| DE | 2100489 | 7/1971 |

(Continued)

*Primary Examiner*—Timothy D Collins
(74) *Attorney, Agent, or Firm*—Connolly Bove Lodge & Hutz LLP

(57) ABSTRACT

This disclosure relates to a method of limiting the yawing motion on the trajectory of an artillery shell during the firing phase using a sliding driving band and completely folded-in guide fins. The shell is converted as soon as possible outside the mouth of the barrel of the firing piece by fold-out of the guide fins into a fin-stabilized artillery shell. Any form of non-uniform fin fold-out is avoided by virtue of all the guide fins being interconnected to form a system which gives all the fins the same movement pattern and the same fold-out speed in each phase of fin fold-out. This disclosure also includes a shell in which synchronization of fin fold-out includes a rotatable control ring that is arranged around the axis of the shell and is connected to the rotation spindles of all the fins.

3 Claims, 4 Drawing Sheets

U.S. PATENT DOCUMENTS

| | | | |
|---|---|---|---|
| 4,554,989 | A | 11/1985 | Gruich et al. |
| 4,575,025 | A | 3/1986 | Sadvary et al. |
| 4,624,424 | A | 11/1986 | Pinson |
| 4,683,830 | A | 8/1987 | Corlett et al. |
| 4,690,350 | A | 9/1987 | Grosso et al. |
| 4,699,333 | A | 10/1987 | Pinson |
| 5,016,836 | A | 5/1991 | Thouron et al. |
| 5,048,772 | A | 9/1991 | Wisshaupt et al. |
| 5,505,408 | A | 4/1996 | Speicher et al. |
| 5,630,564 | A | 5/1997 | Speicher et al. |
| 5,662,290 | A | 9/1997 | Voigt |
| 5,829,715 | A | 11/1998 | Banks |
| 5,904,319 | A | 5/1999 | Hetzer et al. |
| 5,950,963 | A | 9/1999 | Speicher et al. |
| 5,975,461 | A | 11/1999 | Ullrich et al. |
| 6,247,666 | B1 | 6/2001 | Baker et al. |
| 6,336,609 | B1 | 1/2002 | Johnsson |
| 6,360,987 | B1 | 3/2002 | Sallaee et al. |
| 6,454,205 | B2 | 9/2002 | Niemeyer et al. |
| 6,474,594 | B1 | 11/2002 | Johnson et al. |
| 6,571,715 | B1 | 6/2003 | Bennett et al. |
| 6,637,699 | B2 | 10/2003 | Banks et al. |
| 6,869,043 | B1 | 3/2005 | Carlyle et al. |
| 6,921,052 | B2 | 7/2005 | Lawless |
| 2003/0146342 | A1 | 8/2003 | Hellman |
| 2004/0011269 | A1 | 1/2004 | Echenique Gordillo |
| 2004/0011920 | A1 | 1/2004 | Johnsson et al. |
| 2004/0021034 | A1 | 2/2004 | Hellman |
| 2004/0069177 | A1 | 4/2004 | Klein |
| 2004/0144888 | A1 | 7/2004 | Dryer et al. |
| 2005/0116113 | A1 | 6/2005 | Lawless |

FOREIGN PATENT DOCUMENTS

| | | |
|---|---|---|
| DE | 1728305 | 4/1972 |
| DE | 2728388 | 1/1978 |
| DE | 3400083 | 8/1984 |
| EP | 0448437 | 9/1991 |
| SE | 508858 | 11/1998 |
| WO | WO-98/43037 | 10/1998 |

METHOD OF SYNCHRONIZING FIN FOLD-OUT ON A FIN-STABILIZED ARTILLERY SHELL, AND AN ARTILLERY SHELL DESIGNED IN ACCORDANCE THEREWITH

CROSS-REFERENCE TO RELATED APPLICATIONS

This application is a divisional application under 35 U.S.C. 121 of co-pending U.S. patent application Ser. No. 10/471,458, filed on Apr. 27, 2005. Application Ser. No. 10/471,458 is a National Stage of PCT/SE02/00550, filed on Mar. 20, 2002, which claims priority under 35 U.S.C. § 119 to Swedish Application 0100956-2, filed on Mar. 20, 2001. The entire contents of each of these applications is incorporated herein by reference.

BACKGROUND

The present invention relates to a method of synchronizing fin fold-out on a long-range artillery shell which is fin-stabilized on its trajectory towards the target and is intended to be fired from a rifled barrel and is to this end provided with a sliding driving band as the main contact surface against the inside of the barrel and also with a number of stabilizing fins which can be folded out after the shell has left the barrel. The purpose of the sliding driving band is to allow the shell, in spite of the rifling of the barrel, to leave the latter with only low rotation or no rotation at all.

It is particularly characteristic of the method and the shell according to the invention that the stabilizing fins of the shell are interconnected by specially designed movement transmission means which bring about uniform fold-out of all the fins irrespective of how these are loaded during the fold-out phase itself Even if the shell should leave the barrel entirely without rotation, the fins arranged around the shell will nevertheless be loaded differently during the fold-out phase by the forces generated by the air flowing past. This is because it has proved to be impossible to avoid any type of shell being subjected to a certain conical yawing motion on its trajectory, and this yawing motion begins immediately after the shell has left the mouth of the barrel.

The reason why an artillery shell is fin-stabilized instead of being rotation-stabilized may be, for example, that it is desirable to make it guidable on its way towards the target, and it is considerably easier to correct the course of a fin-stabilized shell than of a rotation-stabilized shell, and this is the case irrespective of whether the course correction concerned is intended to be performed by impulse motors, steering rudders or in another manner.

It is a requirement of the shell according to the invention that it should be capable of being given an extra long range. A method used increasingly in recent years of achieving extremely long ranges even in older barrel-type artillery is the base-bleed technique, which is used in order to eliminate the turbulence and negative pressure which are formed behind the shells flying through the atmosphere and have a braking effect on the shells and shorten their flying distance. The base-bleed technique is based on arranging a combustion chamber in the rear part of the shell, which chamber is filled with a slow-burning pyrotechnic composition which, while it burns, produces combustion gases which are allowed, in a predetermined quantity, to flow out through an opening in the rear end wall of the shell and there eliminate and fill the abovementioned braking turbulence and negative pressure behind the shell.

When a shell is to be provided with both a base-bleed unit and stabilizing fins, however, it is easy for positioning problems to arise, because the base-bleed unit definitely has to be arranged in the rear part of the shell with at least one gas outflow opening in the rear end wall of the shell, while the fins too ought to be positioned in the rear body of the shell as far away as possible from the centre of gravity of the shell, that is to say fins and base-bleed unit should preferably be arranged within the same part of the shell. An additional problem is that, in order to allow firing of the shell from a rifled barrel, the fins must be fully folded in inside the minimum diameter of the barrel during firing, at the same time as they must not occupy too great a volume either and thus prevent the use of this space for other purposes such as, therefore, the base-bleed unit or payload.

In a known type of fold-in fin, which takes up little space and can be designed so that, in the folded-in position, the fins can share the rearmost part of the shell with a base-bleed unit, each fin consists of a plate which is fixed to a rotatable spindle arranged in the longitudinal direction of the shell and which, in the folded-out position, will constitute the active area of the fin and, in the folded-in position, is rotated in towards the shell body about its spindle, and is in this position curved in towards the shell body and, until the desired fold-out time, is retained in this position by a protective cover or equivalent. Previously, such fins were designed with a curved shape following the shell body and they retained this shape in the folded-out position as well, but, in recent years, elastically deformable materials have become available, which have such a good shape memory that it is now possible to produce fins which, even after years of incurvation in the folded-in position, essentially recover their original shape. It has therefore become possible to use these materials to produce fins which, as soon as they are given the opportunity, tend to recover the shape they were originally given, and this may have been entirely plane or slightly propeller-shaped or designed in another way so as to be provided with a limited angle of attack relative to the air rushing past. One way, which is relatively simple in terms of manufacture in this context, of giving the fins the desired angle of attack is to provide them with a sharp or gently curved dog-ear design or a few degrees of propeller twist. All these types of guide fins are presupposed at the same time to have a radial main direction seen in the cross-sectional direction of the shell. The angles of action relative to the air rushing past the shell which are chiefly of interest in the case of the guide fins for fin-stabilized shells are usually of the order of 1-2.degree., and corresponding angles of action can of course also be brought about by means of axes of rotation for folding in and folding out the fins which are inclined relative to the longitudinal axis of the shell, but this would as a rule involve more expensive overall solutions.

As an example of the state of the art, WO 98/43037 may be mentioned, in which a fin-stabilized artillery shell with fold-out stabilizing fins of the type described above is disclosed.

In the introduction, it was stated that every type of artillery shell is already subjected to a certain form of conical yawing motion on the trajectory immediately after it has left the mouth of the barrel and that this results in fold-out fins arranged on the shell being subjected to different degrees of loading by the relative wind of the surrounding air, which can moreover, to some extent, be from different directions. In brief, this means that the various fins on a fin-stabilized artillery shell will be loaded differently during the fold-out phase itself. In the case of shells provided with sliding driving bands, the centrifugal force acting on the fins is of little importance for fin fold-out. Instead, the majority of the fold-out force comes from the straightening force of the fin material, that is to say the force which is generated when the elastic deformation of the fin material returns to the original shape the fin was once given. In their folded-in position, elastically deformed fins of the type concerned here will quite simply spread out by virtue of their own built-in force but, in spite of this, the fold-out function cannot be left entirely to this mechanical energy development, inter alia because it is clearly most marked during the initial introductory phase of fold-out. For this reason, the fins are normally also provided in the previously indicated manner with a small angle of attack relative to the flying direction of the shell, so that the forces of the air will, above all in the final stage of fold-out, make their contribution to the requisite fin fold-out force. However, on account of the yawing motion of the shell, the air forces may vary quite considerably in strength and direction between the different sides of the shell because the relative wind against the shell is dependent on the yawing motion of the shell which begins directly outside the mouth of the barrel. A fin on one side of the shell could therefore, if it were able to define its own fold-out speed, have such a high fold-out speed that its strength is put at risk, while a fin on another side of the shell could at the same time have such a low fold-out speed that it does not completely reach its intended radial position.

SUMMARY

Accordingly, the object of the present invention is to eliminate, in a reliable manner, the effects of an otherwise readily occurring incomplete fin fold-out, and this is achieved by fold-out of the fins in relation to one another being synchronized using means adapted thereto. According to the invention, the fins are therefore to be interconnected in such a manner in relation to one another that they are folded out at the same speed. The invention therefore concerns a method of forcing the fins most heavily loaded in the fold-out direction to share the fold-out force acting on them with fins which are more lightly loaded in the fold-out direction at the same time as the latter are to force the more heavily loaded fins to slow down their fold-out speed and thus also to reduce the risk of them being overloaded. The basic principle of the invention is therefore that all the fins are to be connected by means of a common fin fold-out control or synchronizing arrangement which is to be designed in such a manner that it gives all the fins a simultaneously initiated uniform fold-out at the same speed from their initial folded-in position with that part of the fin blade or the active area of the fin which lies closest to the spindle extending tangentially to the immediately adjacent outer side of the shell into a folded-out position in which the fin blades are angled at in principle 90.degree. relative to the folded-in position, in which position the fin blades or the active areas of the fins extend radially out from the shell body. The invention also includes the fact that the fins should, via the synchronizing arrangement, help one another with fold-out or alternatively brake one another as required. A direct drive function is therefore, at least in the first place, not intended to be included in the system. An essential part of fin fold-out is also that the fin plates which constitute the active areas of the fins recover elastically from their incurvation towards the shell body to the finally intended shape they were once given. Another advantage of the invention is that, in an especially preferred embodiment, it requires very limited extra space and by virtue of this makes it possible to arrange both the fold-out fins and a base-bleed unit within the same part of the shell.

The invention therefore provides a method and an arrangement which guarantee that the fold-out fins on an artillery shell with a sliding driving band fired from a rifled barrel achieve their completely folded-out and locked end position. It is characteristic of the method and the arrangement according to the invention in this connection that any form of non-uniform fin fold-out and associated negative influence on the flight of the shell will be avoided by virtue of all the guide fins being interconnected by means adapted thereto to form a system which, during the fold-out phase, gives the fins a synchronized movement pattern with simultaneous and uniform fold-out movements.

In order to make it possible to perform such a synchronized fin fold-out function, we have introduced a movement transmission means which connects all the rotation spindles around which the fins have, during the firing phase, been curved in towards the shell body, in which position they have been retained by a special protective cover from the completion of the shell during manufacture until it leaves the mouth of the barrel. When the shell leaves the mouth of the barrel, the protective cover is torn away from the shell by an inner powder gas pressure which, during the firing phase, is allowed to leak into the cover and which, inside the barrel, is balanced by the powder gas pressure behind the shell. This is because, when the shell leaves the barrel, this counterpressure ceases very rapidly and, by dimensioning the gas supply to the cover so that it is not possible for its inner overpressure to be eliminated at the same rate as the abrupt reduction in pressure behind the shell takes place, the cover will be thrown off.

As soon as the protective cover has been removed, fin fold-out will begin and, as the method and the arrangement according to the invention are primarily intended for use on shells with sliding driving bands, there is only at the very most a weak centrifugal force available to assist fin fold-out. The majority of the force necessary for fin fold-out therefore has to be obtained, as already mentioned, from the straightening force built into the fins and also, to some extent, from the relative wind force against the fins of the passing air. The object of the method and the arrangement according to the invention is therefore to even out this non-uniformity and to give all the fins the same fold-out speed.

According to an especially preferred embodiment, the main means of synchronizing the fin fold-out function consists of a control ring which is arranged concentrically around the longitudinal axis of the shell close to its outer wall, can rotate in a groove adapted thereto and connects the various fin spindles and gives these and the active areas of the fins identical movement patterns. In its most developed form, the outer surface of the control ring is designed as a toothed ring and each fin spindle is in turn provided with a corresponding toothed segment covering at least a quarter of a turn. Under certain circumstances, it would probably be possible to replace the toothing with low-cost variants in the form of knurling or another friction-increasing treatment of the outer surface of the control ring and the rotation spindles of the fins. Another possible but, because it would result in so many small parts, less practical solution would be to use a number of links which interconnect cranks rigidly connected to respective spindles.

BRIEF DESCRIPTION OF THE DRAWINGS

The invention is defined in greater detail in the patent claims below and will moreover be described in somewhat greater detail in connection with accompanying figures, in which FIG. 1 shows an oblique projection of an artillery shell while.

FIG. 3 shows the section III-III in FIG. 2 with the fins folded in and covered by a protective cover while FIG. 5 shows a detail from FIG. 4 while

DETAILED DESCRIPTION

Figure 1:
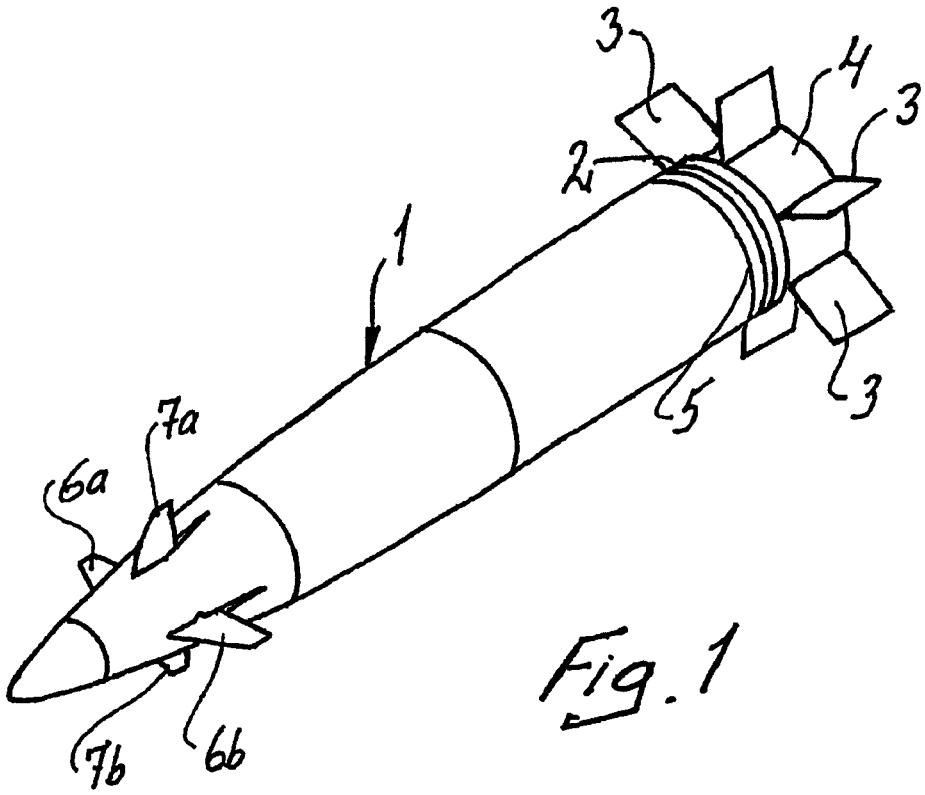

The shell shown in an oblique projection in FIG. 1 represents an example of how a shell designed according to the invention may appear on its way towards the target. The shell in question consists of a shell body 1 provided with a groove for a sliding driving band 2 which has already been lost, a number of folded-out fins 3 which are attached to the rear portion 4 of the shell, the connection of which to the shell body 1 is indicated by the join 5. At the front end of the shell, there are four canard rudders 6*a*, 6*b* and 7*a*, 7*b* which can likewise be folded out and are moreover guidable. All the fins and rudders are designed in such a manner that they can be kept folded in during the firing phase.

Figure 2:
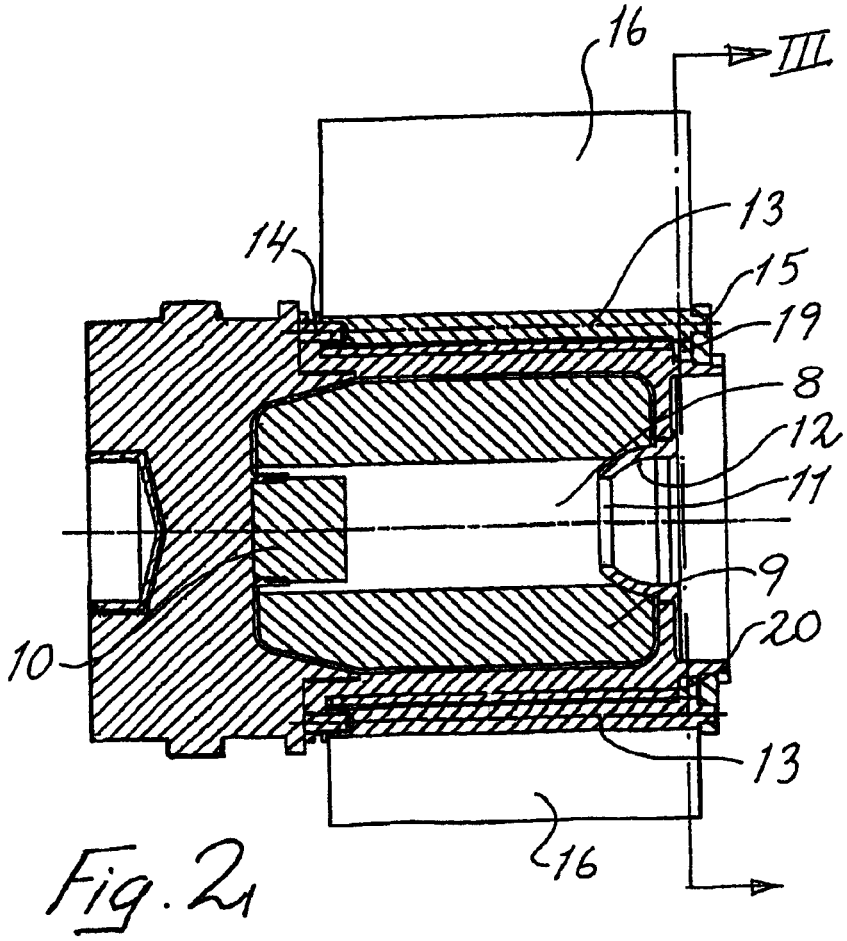
FIG. 2 shows a longitudinal section through the rear part of the shell.

FIG. 2 shows in greater detail how the rear portion 4 is designed. This portion accordingly comprises an inner cavity 8, in which a base-bleed charge 9 is arranged. There is also an initiator 10 for the base-bleed charge and a support dome 12 arranged around the outlet 11 thereof. Each of the fins 3 is attached to a rotatable spindle 13 aligned essentially in the longitudinal direction of the shell. Each such spindle has a bearing point 14 and, respectively, 15 at each end. The active areas of the fins, which consist of plane plates as in FIGS. 2-6 in the folded-out position, have been given the general designation 16.

Figure 3:
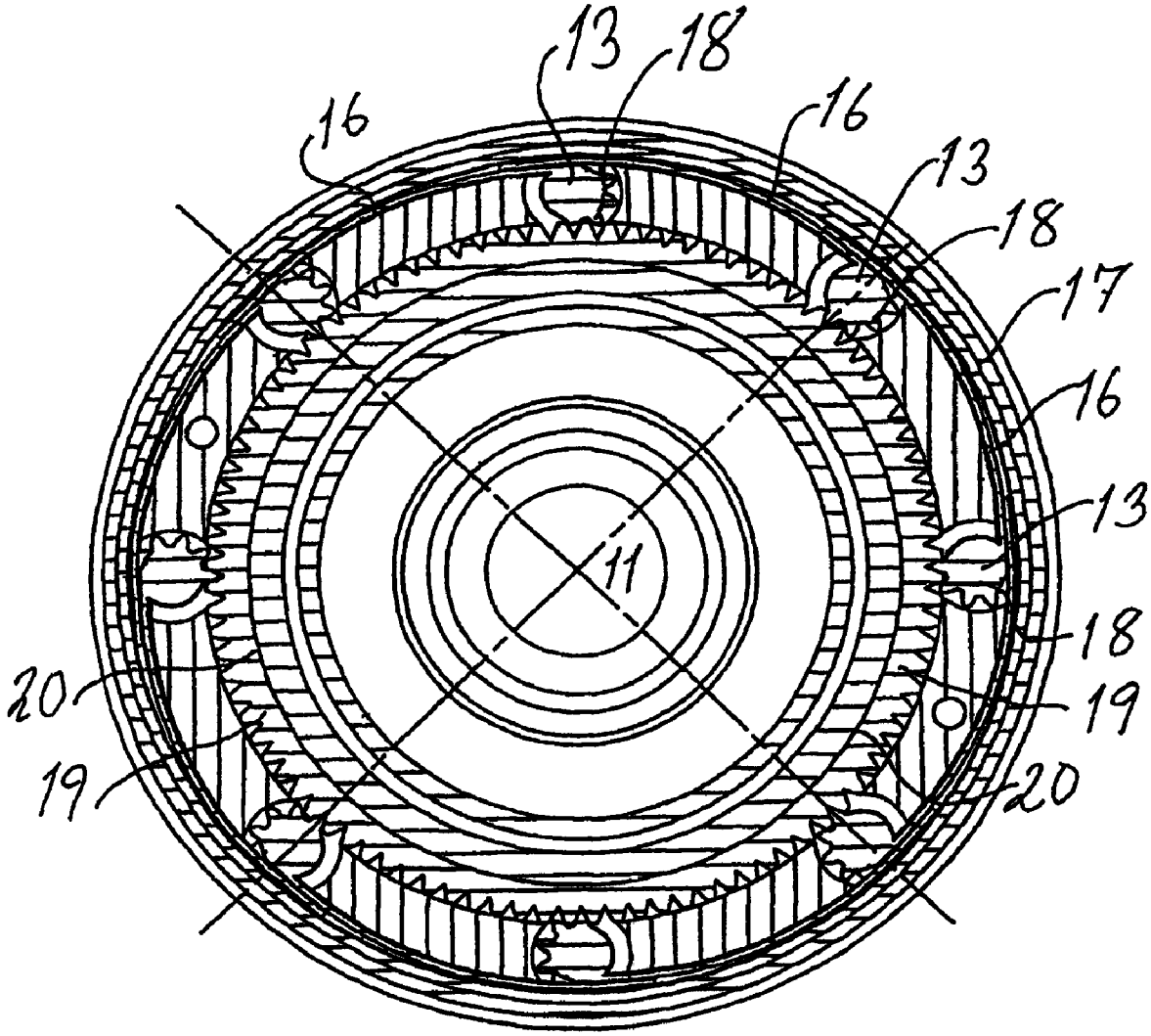
Figure 4:
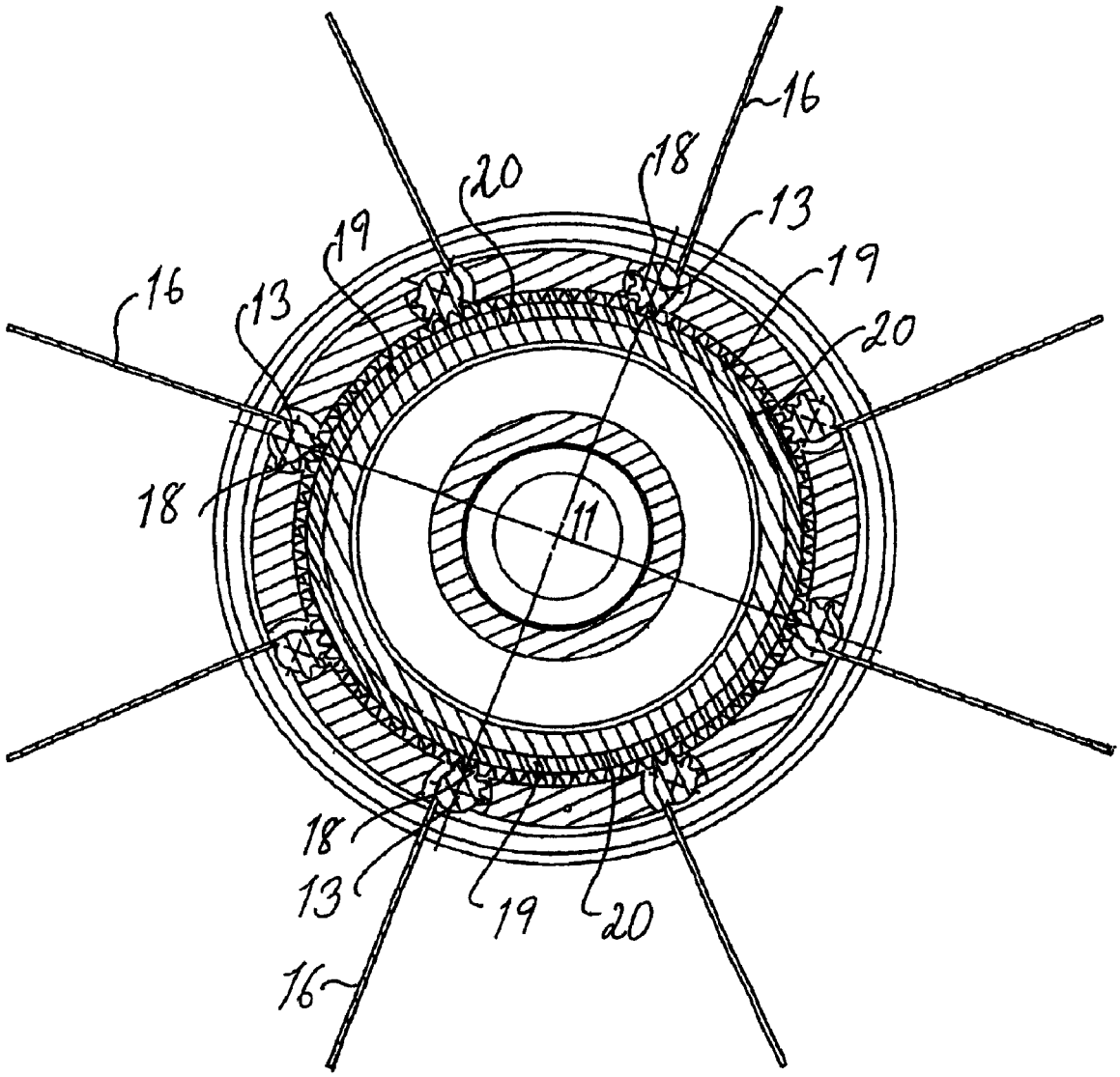
FIG. 4 shows the section III-III in FIG. 2 but with the fins folded out.
Figure 6:
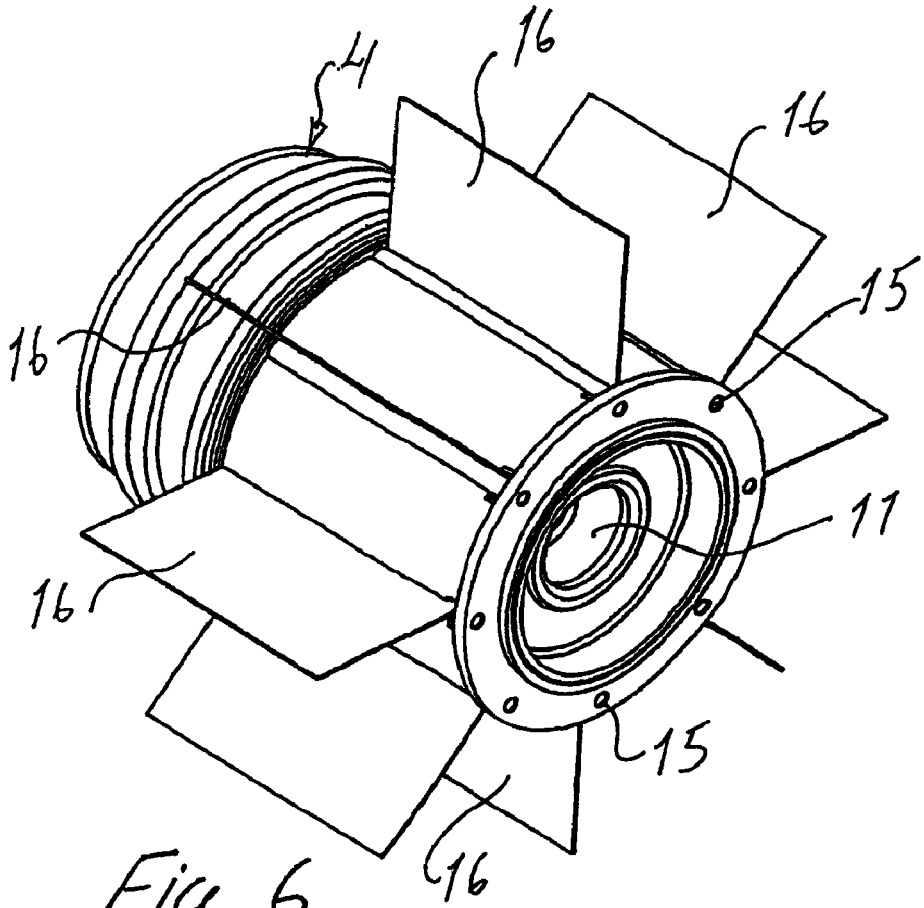
FIG. 6 shows the rear part of the shell according to FIG. 2 but in an oblique projection.

In their folded-in position, the active areas 16 of the fins, which can be seen more clearly in FIG. 3, are on the one hand folded down a quarter of a turn around their respective spindles 13 towards the rear body 4 of the shell so that, in the region of their respective spindles 13, they extend essentially tangentially along the rear body 4, and on the other hand curved in at their respective free outer end along this body and moreover covered by a protective cover 17 which is removed as soon as the shell has left the mouth of the barrel.

In order for it to be possible to bring about the synchronization of fold-out of the fins 16 which is characteristic of the invention, the spindles 13 of the fins are, somewhere along their length, in this case at one of their ends, designed with toothed arcs or toothed segments 18 which in turn are all in engagement with an externally toothed control ring 19 characteristic of the invention, which, in a groove 20 adapted thereto inside the rear body 4 close to its outer wall, runs concentrically around the central outlet 21 of the rear body 4 for the base-bleed charge.

Until and when the shell leaves the barrel from which it is fired, the fins will therefore be covered by the cover 17 which, by interaction between powder gases penetrating into the cover and the vacuum directly outside the mouth of the barrel, is pulled off, whereupon fin fold-out begins immediately. By virtue of the fact that the spindles 13 of all the fins 16, via the toothed arcs 18 and then in turn by the externally toothed control ring or synchronizing means, are interconnected to form a continuous system, all the fins will be folded out at the same speed.

Figure 5:
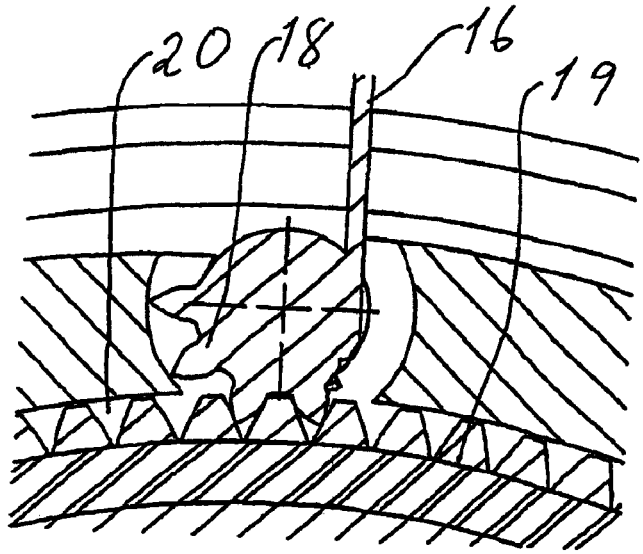

As can be seen from FIGS. 3 and 5 in particular, we have, in the case illustrated, selected a tooth size which, with four teeth for each toothed arc 18 on the spindle 13 of each fin 16, gives a fold-out movement corresponding to a quarter of a turn for the active area 16 of the fin.

What is claimed is:

1. A method for firing an artillery shell having a sliding driving band and completely folded-in and interconnected guide fins from a firing piece, the method comprising:

firing the artillery shell;

converting, as soon as possible outside a mouth of a barrel of the firing piece, the artillery shell by fold-out of the guide fins into a fin-stabilized artillery shell;

avoiding any form of non-uniform fin fold-out by interconnecting all of the guide fins; and forming a system which gives all the guide fins a same movement pattern and a same fold-out speed provided by a straightening force built into the guide fins and/or from a relative wind forces against the guide fins during each of a plurality of fin fold-out phases.

2. The method of claim 1, further comprising:

allowing moving of each of the interconnected fins around a respective rotation spindle arranged essentially in a longitudinal direction of the shell from a first, folded-in position in which an active area of a fin in a region of the rotation spindle lies essentially tangential to a shell body, to a second, folded-out position in which the active area is oriented essentially radially relative to the shell body; and interconnecting each of the fins to form a continuous system which assists with braking a fold-out of each of the fins according to a wind load acting on the active area of each fin.

3. The method of claim 1, further comprising:

controlling an interaction of a relative fold-out of each of the fins by using a toothed ring connecting the fin spindles and a corresponding toothing on each fin spindle.

* * * * *